United States Patent [19]

Brandon

[11] Patent Number: 4,976,430

[45] Date of Patent: Dec. 11, 1990

[54] MOVABLE BASES FOR SOFTBALL AND BASEBALL PLAYING FIELDS

[76] Inventor: Ronald E. Brandon, 1734 Lenox Rd., Schenectady, N.Y. 12308

[21] Appl. No.: 390,174

[22] Filed: Aug. 7, 1989

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,298,689 | 10/1942 | Ferris | 273/25 |
| 4,817,946 | 4/1989 | Velasquez | 273/25 |
| 4,830,368 | 5/1989 | Green | 273/25 |

FOREIGN PATENT DOCUMENTS

| | | | |
|---|---|---|---|
| 614881 | 2/1961 | Canada | 273/25 |

*Primary Examiner*—Theatrice Brown

[57] ABSTRACT

Bases for baseball and softball are improved to permit yielding when struck by sliding players. The bases are provided with a slot extending diagonally across the lower surface thereof. A slide member is slidably received in the slot to allow the bases to yield when contacted by a player. Spring elements are attached to the slide member and the base to cause the slide member to return to a normal at rest position of the base after being moved as a result of contact by a player.

5 Claims, 2 Drawing Sheets

MOVABLE BASES FOR SOFTBALL AND BASEBALL PLAYING FIELDS

BACKGROUND OF THE INVENTION

Baseball and softball bases for the first, second and third base positions are made to be slightly resilient, then mounted rigidly to the playing surface. At times this arrangement has proven to be disadvantageous to the players, such as when making a hard slide into the base. It is possible, at such times, to badly sprain or fracture the players ankle.

The severity of such injuries could be reduced or eliminated by designing the base to yield at the time of heavy impact. This is the purpose of the present invention.

SUMMARY OF THE INVENTION

Briefly stated, the invention is practiced by providing a base that can resistibly move from the impact of a sliding player, then return to its proper position when permitted by the player, yet avoid motion caused by a base runner not planning a sliding stop at the base. The direction of the motion is controlled by a track in the base and a sliding post which anchors the base to the ground. The resistance to motion and the force for returning the base to its normal position is provided by springs or a combination of springs and shock absorbers.

In light of the foregoing, the object of the invention is to permit the base to yield when contacted by a sliding base runner so as to reduce the impact force on th player.

A seccond objective is to prevent undesirable motion of the base when contacted by a base runner that is not sliding.

Still a further objective is to ensure the automatic relocation of the base back to its normal field position following impact caused by a sliding player.

BRIEF DESCRIPTION OF THE DRAWINGS

For a better understanding of the invention, reference is made to the accompanying drawings in which.

DESCRIPTION OF THE PREFERRED EMBODIMENT

Figure 1:
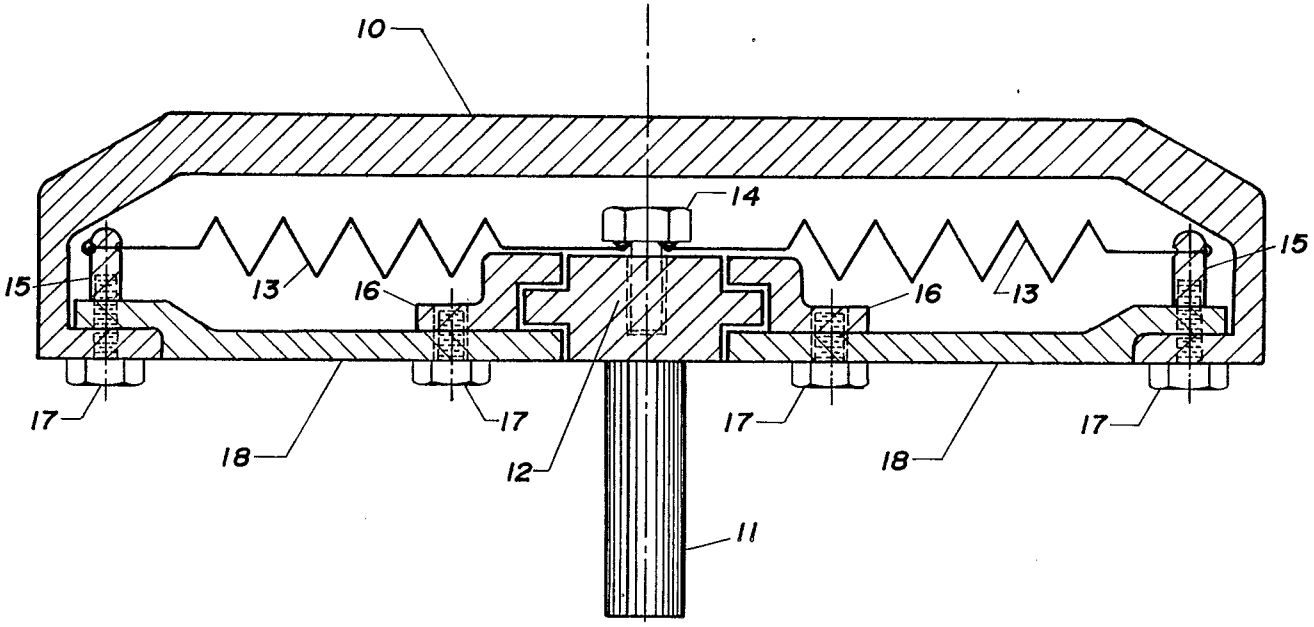
FIG. 1 is a side view drawing, partly in section of the improved base.

Referring to FIG. 1, the external upper surface of the base is shown at 10. The post of the base is shown at 11. It is a vertical post, rectangular cross section. It is inserted into a mating piece (not shown) firmly fixed in the ground to position the base both as to location and angle. The post is firmly attached to a slide plate shown at 12.

The slide plate 12 is positioned vertically by opposing slots formed by guide plates 16 and the bottom cover plates 18. The slots permit the base to slide in one diagonal direction relative to the post, but prevent motion in any other direction.

The slotted guide plates are fastened firmly to the bottom cover plates 18. The bottom cover plates are triangular in shape and are firmly attached to the base 10 also by screw fasteners 17.

A spring post assembly 14 extends from the top of the slide plate 12 to enable a secure connection of the springs 13.

The other end of the springs are connected to the spring pins 15 securely connected to corners of the base 10.

Figure 2:
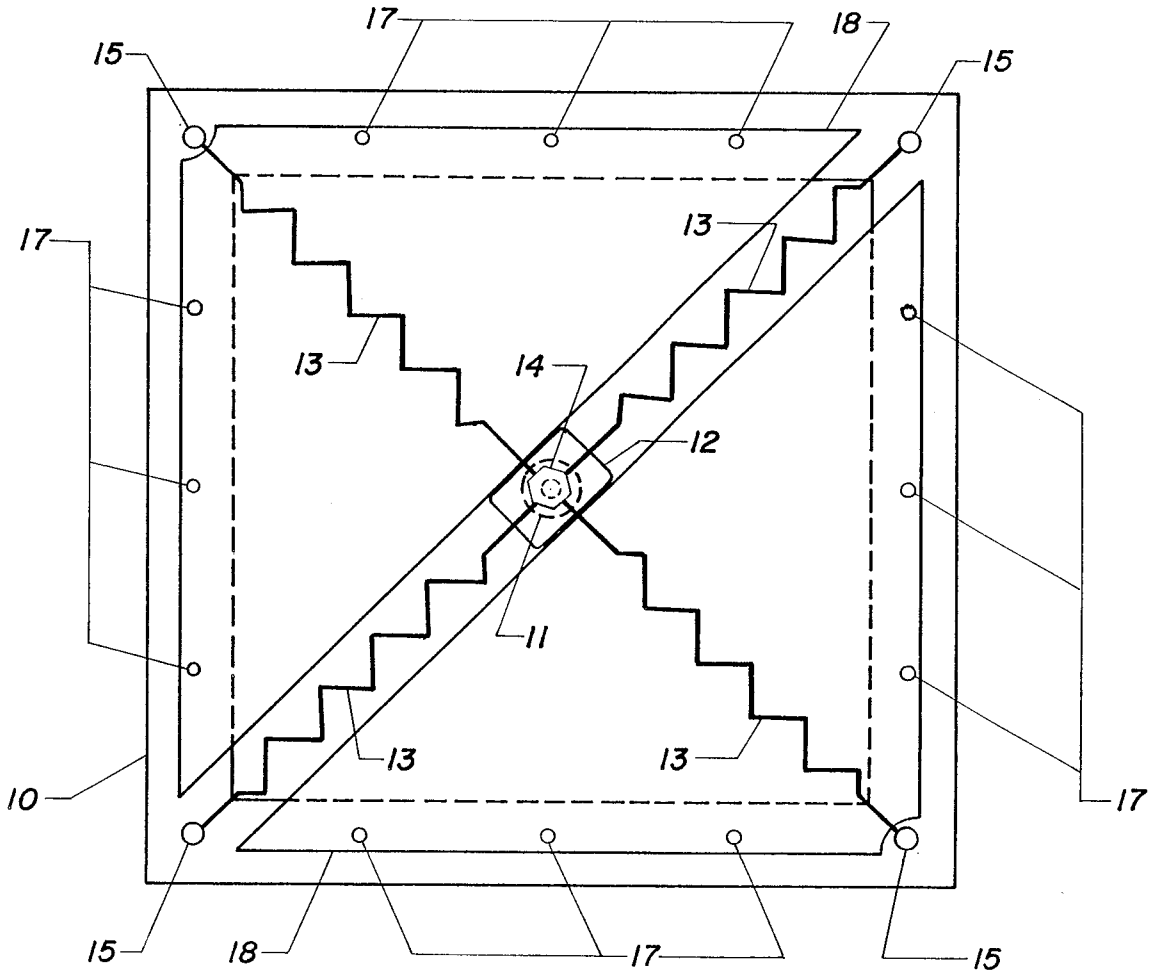
FIG. 2 is a plan view sectionalized drawing of the base looking upward from the bottom.

In FIG. 2, the spring system, comprised of 4 springs 13 is shown connected to the spring post assembly 14 and to the four corners of the base at the spring pins 15.

The slotted guide plates form a track that permits the base to shift diagonally on its post, but not toward or away from home plate. This is the condition for a second base, as selected for the example.

The springs should be pre-stretched to ensure a positive force to cause a return of th base to its neutral position after being pushed away from that position by a sliding base runner. The spring constant of the springs should be selected to permit yielding of the base at a load small enough to minimize the probability of physical damage to a sliding base runner. Naturally this will be smaller for little leaguers than professionals.

Friction will also resist the sliding motion of the base. Some friction is desirable to help reduce the tendency for motion from base-runner shock caused by non-sliding base runners. Friction can be controlled by the material of the slide plate and the opposing slots. It can also be controlled by the use or non use of lubricants.

In operation, the base is positioned on the playing field as shown in FIG. 2. A sliding runner from first base will tend to drive the base in the direction of left field. If the base is rigidly mounted, a hard slide can result in strained or a broken ankle. If the base can yield, the probability of injury is significantly decreased.

It is also desirable that the base resist yielding from the impact of a base runner rounding second and turning toward third base. The impact, in this case, will normally tend to drive the base toward center field, a direction of motion that is prevented by the guide plates that permit motion only toward left field or right field.

A sliding runner returning to second base from the direction of third base will also obtain some yielding of the base in case of a hard slide. A different direction for base motion would naturally be chosen for first or third base. It is recognized that other angles than the 14° angle of motion depicted on FIG. 2 may be employed.

It is also noted that increased resistance to rapid motion can be achieved by the use of shock absorbers arranged in parallel with the springs.

The spring post 14 can employ a variety of means to enable easy connection with the springs but such that the connection will not be lost when sudden heavy shocks and motion occur.

It is noted that a flexible membrane could be placed on the bottom of the base to preclude dirt from entering the sliding surfaces and undesirably changing the level of friction.

Various other modifications of the invention may occur to those skilled and it is desired to secure by the appended claims, all such modifications as fall within the true spirit and scope of the invention.

What we claim as new and desire to secure by letters patent of the United States is:

1. A yielding base for securement at a selected location a playfield comprising: a substantially square member having an upper player engaging surface member and a lower ground anchor support surface member, said lower surface member being spaced from said upper surface member by a peripheral wall, said lower surface member having an elongated slot extending diagonally across said base, a slide member positioned in said elongated slot for sliding along said slot, guide means for confining said slide member in said elongated slot and for guiding said slide member along said elongated slot, spring means extending along said elongated slot, said spring means being attached to said slide member and attached substantially opposed diagonal first pair of corners of said base such that said slide member is held at a normally at rest position and will be returned to said normally at rest position after being released from transverse forces applied to said base, means connected to said slide member for anchoring said base at a selected location on a playfield.

2. A yielding base a defined in claim 1, wherein additional spring mean is attached to said slide member, said additional spring means extending perpendicular to said elongated slot and attached substantially at opposite diagonal second pair of corners of said base, said normally at rest position of said slide member being substantially central of said base.

3. A yielding base as defined in claim 1 wherein, said peripheral wall has an inwardly extending peripheral flange, said lower surface member being comprised of a pair of triangular shaped members, each of said triangular shaped members having two of its edges attached to said flange and their edge being spaced apart to define said elongated slot.

4. A yielding base as defined in claim 1 wherein, said guide means is a guide plate attached to said lower surface member on opposite sides of said elongated slot and extending along said slot, each of said guide plates and said lower surface member defining a groove on opposite sides of said elongated slot, said slide plate having means extending into said grooves and being slidable thereon.

5. A yielding base as defined in claim 1 wherein, shock absorber means is attached to said base and in parallel with said spring means.

* * * * *